United States Patent [19]

Ikeda

[11] 4,291,490

[45] Sep. 29, 1981

[54] MOVING TOYS

[75] Inventor: Masaki Ikeda, Tokyo, Japan

[73] Assignee: Tomy Kogyo Co., Inc., Tokyo, Japan

[21] Appl. No.: 75,809

[22] Filed: Sep. 14, 1979

[30] Foreign Application Priority Data

Sep. 20, 1978 [JP] Japan ..... 53-129058[U]

[51] Int. Cl.[3] ..... A63H 17/00; A63H 11/00; A63H 23/10; A63H 3/12

[52] U.S. Cl. ..... 46/251; 46/119; 46/92; 46/153; 273/86 E

[58] Field of Search ..... 46/119, 248, 1 C, 266, 46/267, 92, 249, 251, 189, 207; 40/415, 419; 273/86 E, 86 H; 180/7 R; 74/112, 61, 84 S, 87

[56] References Cited

U.S. PATENT DOCUMENTS

| | | | |
|---|---|---|---|
| 934,025 | 9/1909 | Steiff | 46/119 |
| 1,888,544 | 11/1932 | Simmen | 74/87 |
| 2,167,068 | 7/1939 | Gueydan | 46/201 |
| 2,611,557 | 9/1952 | Donovan | 74/61 |
| 2,766,849 | 10/1956 | Rudiger | 46/119 |
| 2,886,976 | 5/1959 | Dean | 74/112 |
| 3,196,580 | 7/1965 | Rakestraw | 46/1 C |
| 3,339,422 | 9/1967 | Petrin | 74/87 |
| 3,530,617 | 9/1970 | Halvorson et al. | 46/251 |
| 3,841,636 | 10/1974 | Meyer | 46/1 C |
| 3,855,725 | 12/1974 | Tollefson | 46/1 C |
| 4,076,245 | 2/1978 | Monroe | 273/86 C |
| 4,152,943 | 5/1979 | Wall | 74/61 |
| 4,195,703 | 4/1980 | Hawkins | 180/7 R |
| 4,219,957 | 9/1980 | Kakuta | 46/251 |

FOREIGN PATENT DOCUMENTS

| | | | |
|---|---|---|---|
| 1145460 | 10/1957 | France | 46/1 C |
| 1432598 | 4/1976 | United Kingdom | 46/92 |

*Primary Examiner*—Gene Mancene
*Assistant Examiner*—Michael J. Foycik
*Attorney, Agent, or Firm*—Edward D. O'Brian

[57] ABSTRACT

Structures which are considered to be primarily useful as toys can be constructed utilizing members or arms adjustably mounted on a rotating shaft within the body of such a structure. By shifting the positions of such members or arms the type of movement of such a structure on a supporting surface can be varied. If desired, adjacent of such structures may be connected through the use of flexible couplings such as suction cups.

10 Claims, 5 Drawing Figures

MOVING TOYS

BACKGROUND OF THE INVENTION

The invention set forth in this specification pertains to structures primarily useful as toys which are adapted to move upon an appropriate supporting surface such as, for example, a table top.

In the past a wide variety of different types of vehicular and animated toys which have been adapted to move relative to a supporting surface such as a table top have been constructed and used. Many different mechanisms have been employed for moving the bodies of such toys relative to a supporting surface. Commonly such toys have been constructed so as to be supported on such a surface through the use of wheels; commonly such toys have been constructed so that mechanical power such as is derived from any conventional type of motor is used to rotate such wheels.

On occasion various other somewhat unusual means of supporting and moving such structures have been utilized. Thus, for example, it is known to utilize the force of air to support and/or move various toy and other structures, to utilize magnetic levitation for the same purposes, and to utilize bristles or bristle type structures for transmitting vibratory motion to the bodies of toys and related structures for the purpose of moving them with respect to a supporting surface. A detailed review of all of these and other methods of imparting motion to the body of a toy or similar structure is not considered necessary to an understanding of the present invention.

It is considered that there is a definite need for structures which are primarily useful as toys and which are constructed in such a manner as to utilize a novel method of moving a body relative to a supporting surface. It is considered that this need is related to the fact that in general toys which are constructed in a comparatively novel, attention attracting manner tend to be much more commercially acceptable than toys constructed in a known or established manner. Thus it is considered desirable to provide toys which utilize other than essentially known methods of moving such toys as are briefly indicated in the preceding discussion. It is also considered that there is a related very definite need for toys which can be constructed at a comparatively nominal cost utilizing such a novel method of toy movement.

SUMMARY OF THE INVENTION

A broad objective of the present invention is to provide new and improved structures which can be utilized to fulfill the needs indicated in the preceding discussion. The invention is intended to provide structures primarily useful as toys which can be easily and conveniently manufactured at a comparatively nominal cost, which may be easily and conveniently used, and which are capable of being used for reasonable time periods without damage by children. A further objective of the present invention is to provide structures as indicated which may be easily and conveniently adjusted so as to obtain different manners of movement. A still further objective of the present invention is to provide structures as indicated which can be utilized in a series to obtain interesting, attention getting effects.

In accordance with this invention these objectives are achieved by providing a structure having a body adapted to be supported on a surface and means for imparting motion to said body so as to move said body with respect to said surface when it is supported on said surface in which the improvement comprises: said means for imparting motion including a shaft rotatably mounted on said body so as to be capable of being rotated about an axis, a motor for rotating said shaft connected to said shaft, at lest two members, each of which serves as an inertia mass and a mounting means securing each of said members to said shaft so as to extend outwardly from said axis of said shaft, said mounting means permitting the relative positions of said members with respect to the axis of said shaft to be adjusted so as to vary the forces created during operation of said motor so as to rotate said shaft and said members.

BRIEF DESCRIPTION OF THE DRAWING

The invention is best more fully explained in reference to the accompanying drawing in which.

The particular structure illustrated is considered to be a presently prefered embodiment of a structure in accordance with this invention from a structural standpoint. In the interest of minimizing drafting expense this particular structure is not to be considered as a presently preferred embodiment of a structure of this invention from an aesthetic standpoint.

It is believed that it will be apparent to those skilled in the design and construction of toys that the operative principles or features of this invention as are set forth in the appended claims can be utilized in many different ways. Thus, for example, these features can be used in toys which correspond to the illustrated toy structure except as to appearance details. They can also be utilized in toys which mechanically differ from the exact structure shown but which nevertheless utilize the same method of operation as the structure illustrated and as described in this specification.

DETAILED DESCRIPTION

Figure 4:
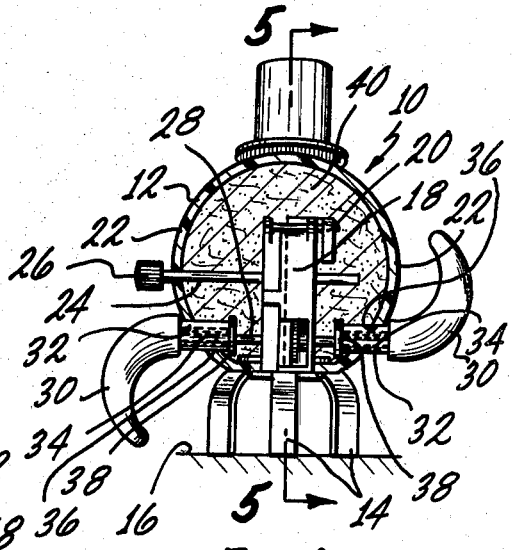
FIG. 4 is a cross-sectional view in which certain parts are shown in elevation taken at line 4—4 of FIG. 1.
Figure 5:
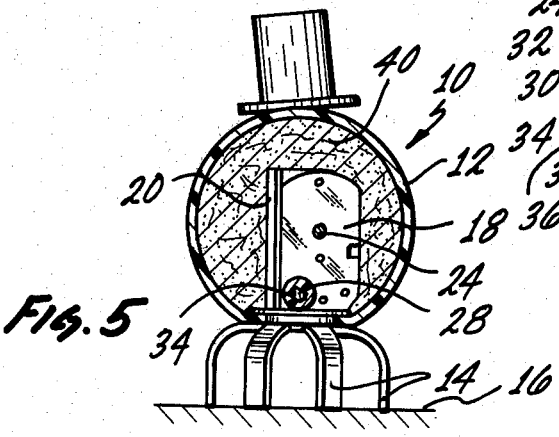
FIG. 5 is a cross-sectional view in which certain parts are shown in elevation taken at line 5—5 of FIG. 4.

In the drawing there is shown a structure 10 which is primarily useful as a toy which includes a relatively rigid, shell-like body 12 formed out of a material such as high-impact styrene having a limited degree of resiliency in the sense that it is capable of transmitting vibration such as a music box tine can transmit vibration. This body 12 may conveniently be formed in any desired shape so as to simulate a real or fanciful animal, structure or the like. Preferably it includes a plurality of legs 14 which are integral with the body 12 and which are adapted to support this body 12 upon an appropriate flat supporting surface 16 (FIGS. 2, 4 and 5) such as a smooth table top or the like. Since these legs 14 are formed of the same material as the rest of the body 12 they possess the resiliency noted.

Within the body 12 a conventional or known motor 18 of any desired type is directly secured to the body 12 through the use of a supporting or mounting bracket 20 so as to be capable of transmitting vibration to the body 12. This bracket 20 extends from the lower portion (not separately numbered) of the body 12 up into the interior of this body 12. It may be secured to the motor 18 and the body 12 in any known, conventional manner. Preferably the motor 18 is located generally within the center of the body 12 so as to be positioned approximately midway between sides 22 of this body 12. The particular motor 18 illustrated is a known spring motor which is adapted to be wound so as to move the structure 10 upon a surface such as the surface 16 through the use of a conventional shaft 24 extending outwardly from the motor 18 through one of the sides 22. A small winding knob 26 is preferably located on the shaft 14 for the obvious purpose.

The motor 18 carries a shaft 28 which extends outwardly from the motor 18 generally toward each of the sides 22. An arm 30 having a cylindrical shoulder 32 is mounted on each end (not separately numbered) of the shaft 28 through the use of a cylindrical socket 34. These scokets 34 are dimensioned so as to frictionally engage the shaft 24 in such a manner that when one of the arms 30 is held stationary the relative position of the other of the arms 30 with respect to the shaft 24 and the immobilized arm 30 can be manually altered or changed. If desired the sockets 34 and the portions of the shaft 28 engaged within these sockets 34 may be referred to as mounting means permitting relative adjustment of positions as indicated. The arms 30 are located so that the shoulders 32 extend through openings 36 in the sides 22. These arms 30 are blocked against removal from the body 12 by flanges 38 on the shoulders 32 engaging portions of the interior of the body 12.

The operation of the structure 10 is essentially exceedingly simple. When the structure 10 is to be utilized on a supporting surface 16 as noted the motor 18 is wound. This in turn causes rotation of the shaft 28. This in turn rotates the arms 30. The frictional contact between the arm 30 and the shaft 28 is such that the arms 30 are immovable relative to the shaft 28 during such rotation. During such rotation the arms 30 serve as eccentric weight or inertia masses.

Because these arms 30 are not aligned with the axis of rotation of the shaft 28 such operation of the motor 18 causes the production of what may be referred to as inertia forces which are transmitted through the shaft 28, the motor 18 and the bracket 20 to the body 12 so as to cause the entire structure 10 to shift or move to a degree with respect to a supporting surface such as the surface 16. Such movement in and of itself is considered important in achieving an attention attracting action in connection with the structure 10. It is considered important that the type of such movement can be varied to a degree of adjusting the relative positions of the arms 30 about the axis of rotation of the shaft 28 in various manners. This is considered important from a play value standpoint.

Although the structure 10 is primarily intended for use on a surface such as the surface 16 it is considered important that this structure 10 can also be utilized as a bathtub-type toy. In adapting the structure 10 for such use it is considered desirable to fill the interior of the body 12 with a mass or body 40 of buoyant material such as, for example, expanded polystyrene. This body 40 also tends to reinforce the body 12 against breakage. When the structure 10 described is utilized as a water toy the rotation of the arms 30 achieves a swimming-type action.

Figure 1:
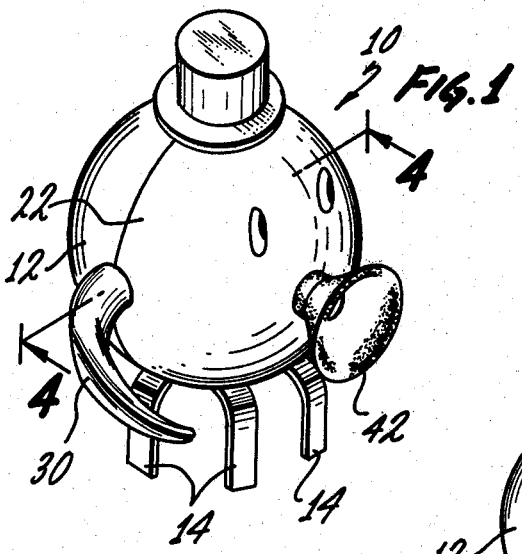
FIG. 1 is an isometric view of a toy structure in accordance with this invention.
Figure 2:
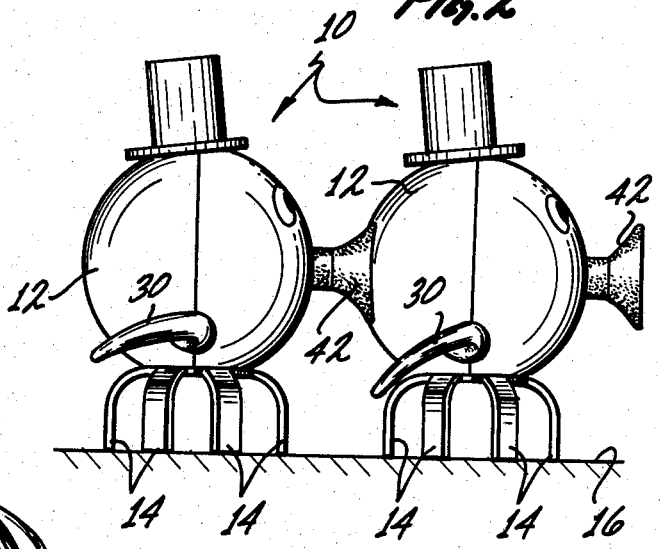
FIG. 2 is a side elevational view indicating two structures as illustrated in FIG. 1 used together in a series.
Figure 3:
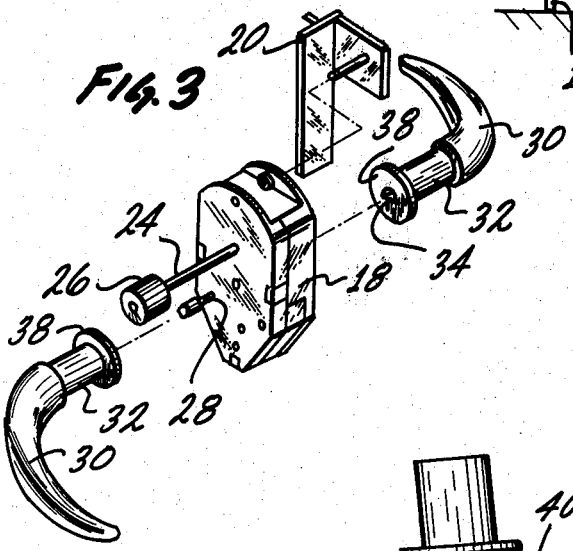
FIG. 3 is an exploded isometric view of certain operative parts as are used in the structure as shown in FIG. 1 for imparting motion to the structure shown in FIG. 1.

If desired a common suction cup 42 may be mounted on the body 12 of a structure 10 in a location out of the way of movement of the arms 30 such that the suction cup 42 on one structure 10 may be used to connect such structure 10 to another identical or similarly formed structure 10 as indicated in FIG. 2 of the drawing. The suction cup 42 illustrated in connection with the structure 10 is considered to be quite desirable since it serves as a form of a flexible coupling connecting two structures such as the structure 10 in such a manner that they will move concurrently as they are operated. As such connected structures 10 are operated the particular vibration within one of the structures 10 is effectively isolated from the other of the structures 10 by a suction cup 42. As a result of this when a series of two or more of the structures 10 connected as indicated in FIG. 2 is created and operated the composite movement of the series is primarily the result of the individual movement of each of the structures 10 within the series. This is considered to be somewhat interesting from a play value aspect.

I claim:

1. A structure having a body having resilient legs which are adapted to support said body on a surface and means for imparting motion to said body so as to move said body with respect to said surface when it is supported on said surface in which the improvement comprises:

said means for imparting motion including a shaft rotatably mounted on said body so as to be adapted to be rotated about an axis, a motor for rotating said shaft connected to said shaft, at least two members, each of which serves as an inertia mass and a mounting means securing each of said members to said shaft so that said members extend outwardly from said axis of said shaft, said mounting means permitting the relative positions of both of said members with respect to the axis of said shaft to be independently adjusted so as to vary the forces created during operation of said motor so as to rotate said shaft and said members, flexible coupling means for use in attaching said body of said structure to a corresponding body of another corresponding structure.

2. A structure as claimed in claim 1 wherein:

each of said mounting means is a connection holding one of said members to said shaft by friction.

3. A structure as claimed in claim 1 wherein:

said body has sides, said motor means is located within said body midway between said sides, said shaft extends through said motor means to adjacent to each of said sides, said members are arms carried by said shaft which extend outwardly from said sides.

4. A structure as claimed in claim 3 wherein:

said mounting means comprise cooperating parts on said shaft and said arms which frictionally engage one another.

5. A structure as claimed in claim 1 wherein:

said flexible coupling means is a suction cup.

6. A structure as claimed in claim 1 wherein:

said flexible coupling means is a suction cup mounted on said body for use in connecting said structure to another corresponding structure and wherein said body has sides, said motor means is located within said body midway between said sides, said shaft extends through said motor means to adjacent to each of said sides, said members are arms carried by said shaft which extend outwardly from said sides, said mounting means comprise cooperating parts on said shaft and said arms which frictionally engage one another, said arms are shaped so as to be adapted to propel said structure through water during rotation of said shaft.

7. A structure as claimed in claim 6 wherein:

said shaft is connected to said body through said motor so that as said arms are rotated forces are created and are transmitted to said body through said motor and said shaft.

8. A structure having a body having resilient legs which are adapted to support said body on a surface and means for imparting motion to said body so as to move said body with respect to said surface when it is supported on said surface in which the improvement comprises:

said means for imparting motion including a shaft rotatably mounted on said body so as to be adapted to be rotated about an axis, a motor for rotating said shaft connected to said shaft, at least two members, each of which serves as an inertia mass and a mounting means securing each of said members to said shaft so that said members extend outwardly from said axis of said shaft, said mounting means permitting the relative positions of both of said members with respect to the axis of said shaft to be independently adjusted so as to vary the forces created during operation of said motor so as to rotate said shaft and said members, said body having sides, said motor means being located within said body midway between said sides, said shaft extending through said motor means to adjacent to each of said sides, said members being arms carried by said shaft which extend outwardly from said sides, said arms being shaped so as to be adapted to propel said structure through water during rotation of said shaft.

9. A structure as claimed in claim 8 wherein:

each of said mounting means is a connection holding one of said members to said shaft by friction.

10. A toy which comprises:

two separate structures, each of said structures including a body having resilient legs which are adapted to support said body on a surface and means for imparting motion to said body so as to move said body with respect to said surface when it is supported on said surface, each of said means for imparting movement including a shaft rotatably mounted on one of said bodies so as to be adapted to be rotated about an axis, a motor for rotating said shaft connected to said shaft, at least two members each of which serves as an inertia mass and a mounting means securing each of said members to said shaft so that said members extend outwardly from said axis of said shaft, said mounting means on said structures permitting the relative positions of said members to be independently varied with respect to the axis of rotation of the shafts with which they are associated so as to vary the forces created during the operation of said motors, flexible coupling means connecting said bodies of said structures so that said connected structures will move concurrently in accordance with their individual operation.

* * * * *